United States Patent [19]

Ferns

[11] 4,174,183

[45] Nov. 13, 1979

[54] SUPPORT FRAME

[75] Inventor: Derek Ferns, Trelleck, Wales

[73] Assignee: Self-Level Covers Aktiengesellschaft, Basel, Switzerland

[21] Appl. No.: 882,386

[22] Filed: Mar. 1, 1978

[30] Foreign Application Priority Data

Mar. 1, 1977 [GB] United Kingdom ..... 8564/77
Nov. 29, 1977 [GB] United Kingdom ..... 49508/77

[51] Int. Cl.[2] ..... E02D 29/14

[52] U.S. Cl. ..... 404/26; 52/20; 210/164

[58] Field of Search ..... 404/26, 25, 72; 52/19, 52/20, 21; 210/163, 164

[56] References Cited

U.S. PATENT DOCUMENTS

| | | | |
|---|---|---|---|
| 1,517,871 | 12/1924 | Thompson | 404/26 |
| 1,852,928 | 4/1932 | Helling | 404/26 |
| 2,056,362 | 10/1936 | Moore | 404/25 |
| 2,163,221 | 6/1939 | Slocum | 404/25 |
| 3,218,942 | 11/1965 | Raquet | 404/26 |
| 3,326,100 | 6/1967 | White | 404/26 |
| 3,331,295 | 7/1967 | Sorrell | 404/26 |
| 4,015,373 | 4/1977 | Boissier | 404/25 X |

FOREIGN PATENT DOCUMENTS

| | | | |
|---|---|---|---|
| 201018 | of 1923 | United Kingdom | 404/25 |
| 263262 | of 1926 | United Kingdom | 404/25 |
| 374697 | of 1932 | United Kingdom | 404/25 |
| 384238 | 4/1976 | Sweden . | |

*Primary Examiner*—Nile C. Byers, Jr.
*Attorney, Agent, or Firm*—Young & Thompson

[57] ABSTRACT

A support frame for a man-hole cover or similar article of highway furniture has a vertical wall portion with an outwardly extending flange at one end. Support means for the cover on the inside of the flange is so arranged that the frame can be mounted either with the flange at the upper end of the wall or with the flange at the lower end of the wall, the top of the cover being level with the top of the frame in both cases. When the frame is mounted with the flange at the upper end, the frame is "self-levelling".

7 Claims, 9 Drawing Figures

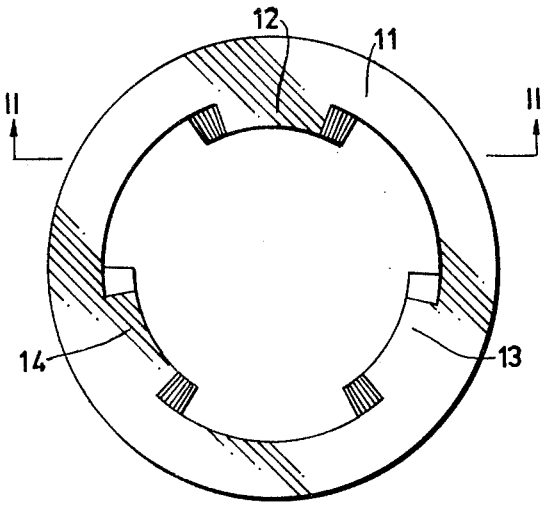
—FIG.1—
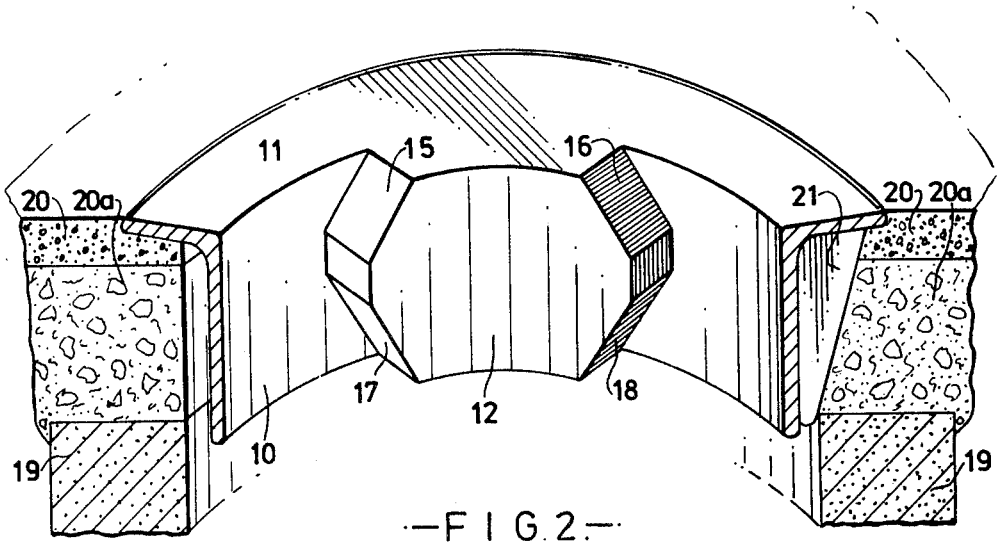
—FIG.2—

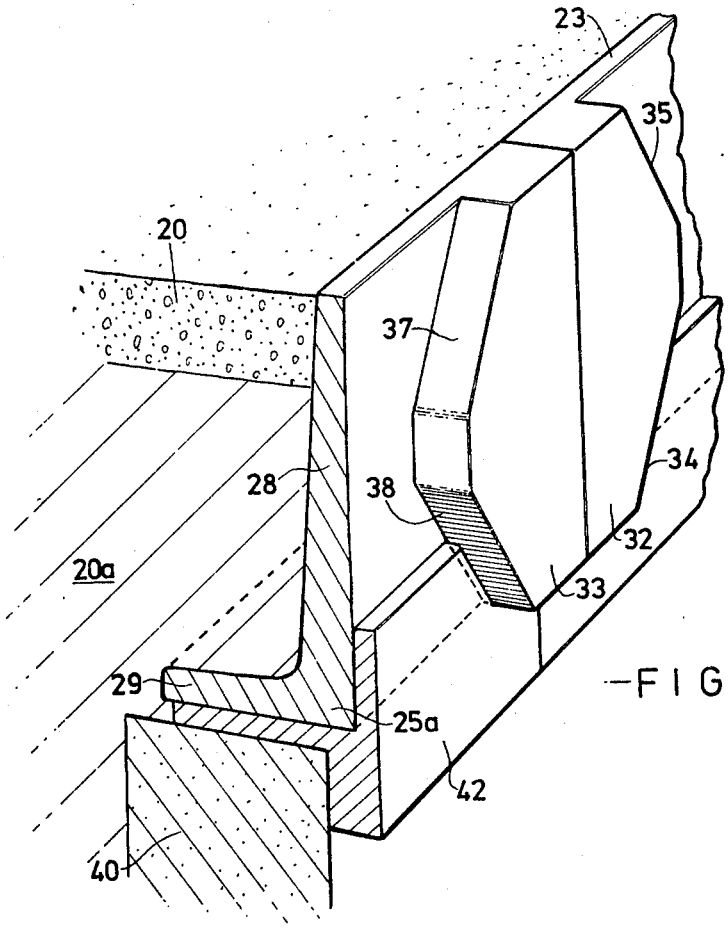
-FIG 6-
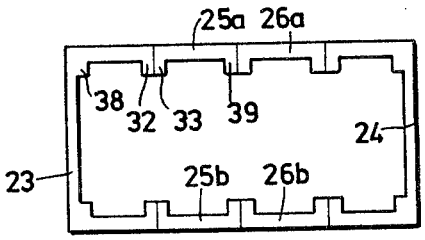
-FIG.3-

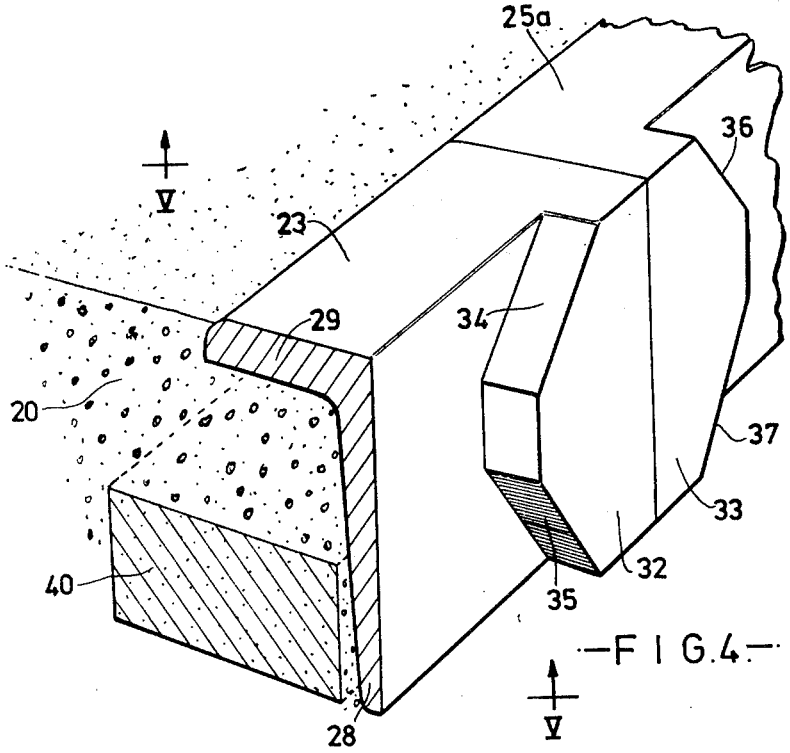
—FIG.4—
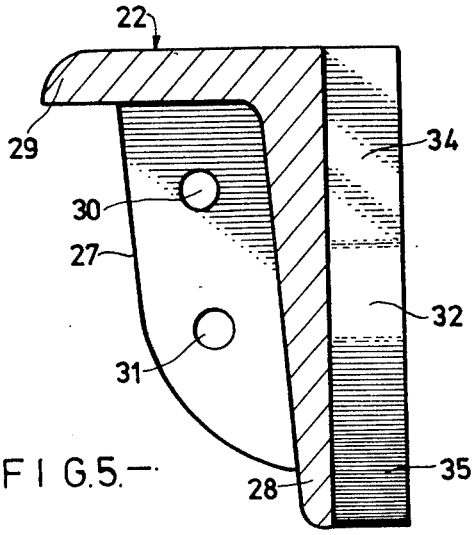
—FIG.5—

-FIG.7-
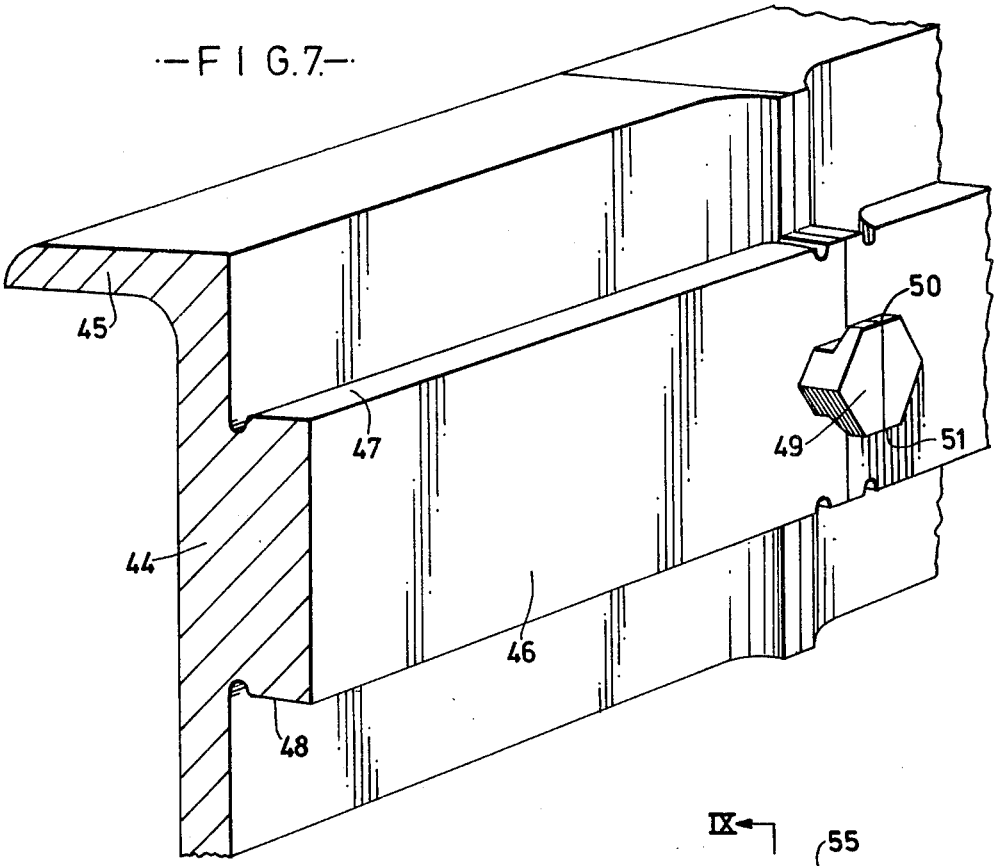
-FIG.8-
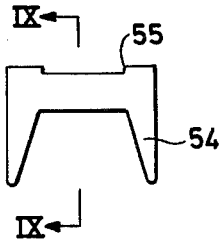
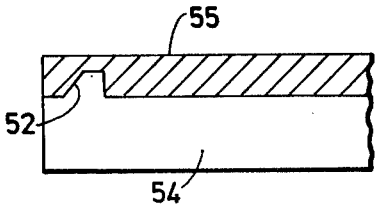
-FIG.9-

SUPPORT FRAME

This invention relates to a frame for supporting articles of highway and carriageway "furniture" such as man-hole covers, gratings and inspection covers.

Throughout the rest of this specification such frames will be described solely as for covers, but it will be understood that these frames could also be used for all other types of highway and carriageway "furniture". Similarly, the frames will be described as positioned in road surfaces, though it will be understood that they could equally well be positioned in other surfaces, such as playgrounds, which have wear resistant surface layers made of, for example, concrete, asphalt, tarmacadam or other coated roadstone.

The standard type of frame for a cover has a generally vertical wall provided, at the bottom end thereof, with an outwardly extending flange. Inwardly extending means provides support for the cover.

When the road is first being made up, the frame is supported on the concrete man-hole ring beam by means of its flange. The road surfacing material is then applied, after which the frame must be repositioned so that the cover lies substantially flush with the finished road surface. This necessitates digging up the road material surrounding the frame, adjusting the height of the frame and then filling up the hole round the frame (patching). Such an operation is obviously undesirable as it considerably extends the time which is necessary for surfacing a road.

Similar problems arise when a road is resurfaced. Here, the frame is raised prior to the arrival of the road surfacing machine and again the frame needs to be dug up, repositioned and patched round.

It is known from Swedish Specification No. 384,238 to form a frame for a man-hole cover having an outwardly extending flange at the top end of the vertical wall instead of at the bottom thereof. The wall of the frame is coupled by a telescopic coupling element to the ring beam and the outwardly extending flange supports the frame and cover by engagement with the roadstone or other surfacing material. The frame is temporarily supported above the required final level while surfacing operations are carried out and subsequently pressed down to the required level.

According to one aspect of the invention, a method of positioning a frame for supporting an article of highway or carriageway furniture, comprises the steps of placing the frame in a predetermined position completely below the desired level of the finished surface, holding the frame in said position utilising temporary support means, laying the surface material, and applying pressure to the newly applied surface so that newly laid road material is forced under the outwardly extending flange of the frame, whereby the frame is supported on this material by said flange and lifted to said desired level.

When a frame is being repositioned, during road resurfacing, by a method in accordance with the invention, the frame is initially raised relative to the old road surface to said predetermined position.

Thus, for both road surfacing and road resurfacing, the frame of the invention "floats" on the newly laid road material. Moreover, the frame is self-levelling, that is to say it adjusts its position to take up the camber or surrounding road shape. Consequently, there is no need for the patching which is necessary when using the known type of frame. Moreover, the finished road surface round the frame and man-hole cover is perfectly smooth.

According to another aspect of the invention, there is provided a frame for supporting a member at the level of a paved surface, the frame being constituted by a wall portion surrounding an aperture whose cross-section matches that of the member to be supported, an outwardly extending flange projecting from one end of the wall portion, and internally extending support means adapted to support said member with its top surface substantially level with said one end of the wall portion when said one end is uppermost and with the other end of the wall portion when said other end is uppermost.

Such a frame can be used both as a frame of the standard type, for mounting with its outwardly extending flange resting on a man-hole ring beam, and as a frame for positioning in accordance with the first-mentioned aspect of the invention.

Preferably, the frame is formed in one piece from spheroidal graphite iron. The advantages of using this particular material are:-

(i) it is lighter than the cast iron normally used;

(ii) it can be machine fitted to very high tolerances so that an accurate fit with the matching cover (also preferably made from spheroidal graphite iron) is ensured; and (iii) it is not susceptible to material change characteristics, such as the stress-relief process which occurs in cast iron for months after its casting, and so it is more stable.

Embodiments of the invention will now be described by way of example with reference to the accompanying drawings, in which:-

FIG. 1 is a plan view of one embodiment of the invention,

FIG. 2 is a cross-sectional view taken on the line II—II in FIG. 1,

FIGS. 3 and 4 are plan and fragmentary perspective views of another embodiment of the invention, FIG. 5 is a cross-sectional view taken on the line V—V in FIG. 4, FIG. 6 is a perspective view, similar to FIG. 4, but showing the frame inverted, FIG. 7 is a fragmentary perspective view of a further embodiment of the invention, FIG. 8 is an end view of a transverse support bar for use with the embodiment shown in FIG. 8, and FIG. 9 is a cross-sectional view taken on the line IX—IX in FIG. 8.

Referring to FIGS. 1 and 2, a frame for a circular man-hole cover has a vertical wall portion 10 with an outwardly extending flange 11 at one end thereof. Three inwardly extending projections 12, 13 and 14 are formed on the wall portion 10. Each of the projections 12, 13 and 14 has inclined end faces, such as the faces 15, 16, 17 and 18 of the projection 12, so that the projections are widest at the middle of the wall 10 and narrower at each end. Thus adjacent pairs of projections define recesses for reception of matching lugs formed on a cover (not shown) which is to be fitted into the frame. When the frame is mounted with the flange 11 uppermost, as shown in FIGS. 1 and 2, the lugs on the cover engage with the inclined faces 15 and 16 of the projection 12 and the corresponding faces on the projections 13 and 14. On the other hand, when the frame is to be mounted the other way up, the inclined faces 17 and 18 are used.

When the frame is to be used with the flange 11 uppermost, as shown in FIGS. 1 and 2, and a road is first being made up, the frame is supported on a concrete man-hole ring beam 19 by means of packing (not shown) constituted by brick pieces, timber or other similar temporary support means. The frame is supported in such a position that it lies completely below the desired level of the finished road. The coated roadstone 20 which forms the top road surface is then applied by any known type of surfacing machine, (not shown) the packing holding the frame in place whilst this occurs, the man-hole cover having previously been placed in position on the projections 12, 13 and 14. After the surfacing machine has passed over the frame, coated roadstone 20 will surround the frame and will lie under the flange 11. The newly laid roadstone 20 is then rolled by means of a road roller (not shown), this rolling process forcing coated roadstone under the flange 11 so as to "float" the frame away from the packing. The roller thus presses the cover and frame to the correct level. Moreover, because of this "floating" or "self-levelling" action, the cover adjusts its position to take up the camber of the road.

Similar conditions apply when road resurfacing takes place, the frame being pulled up above the old road surface in the manner of a cork being drawn from the neck of a bottle. Thus, for both surfacing and resurfacing, the positioning of the man-hole and its frame are accomplished in a single simple operation which does not require a subsequent patching job. Moreover, for both the initial installation and any subsequent repositioning of the frame, the position of the cover and frame prior to the arrival of the spreader need not be accurate, because, after the spreader has passed over the cover and frame, should the cover be found to be too high or too low, its repositioning is easily accomplished whilst the surrounding material is still reasonably soft.

If desired, tapering tabs, such as the tab 21 extending between the underside of the flange 11 and the outside of the wall portion 10, may be provided at intervals round the perimeter of the frame. The outermost inclined surfaces of these tabs are driven into the harder layer 20*a* below the roadstone 19 during rolling of the latter, reducing the proportion of the load to be transfered by the flange 11 to the roadstone 19. This permits the use of a narrower flange than would otherwise have been required.

When a frame of the type illustrated in FIGS. 1 and 2 is to be used with a square or rectangular cover it is necessary to support the cover closely adjacent to each corner. This may be done by providing four recesses, one adjacent to each corner of the frame. Alternatively, two recesses may be provided on opposite sides of the frame, each recess being of such a length that the corresponding lugs extend along most of two mutually opposite sides of the cover. This latter arrangement has the advantage that the cover is supported on such two mutually opposite sides only. Consequently an elongated frame may be covered by a row of such covers without the need to provide intermediate transverse supporting bars under the joints between adjacent covers.

Frames for such multiple cover arrangements are preferably constructed in sections, the joints between sections coinciding with the joints between the individual covers. FIG. 3 shows such a multiple frame which consists of two U-shaped end sections 21 and 22, each capable of supporting a cover (not shown) at a respective end of the row, interconnected by two intermediate sections 23 and 24, each intermediate section consisting of two separate members 23*a*, 23*b* and 24*a*, 24*b*, one on each side of the hole. The frame can therefore support four covers.

FIGS. 4 and 5 show the joint between the sections 23 and 25*a* in more detail. As can be seen in FIG. 5, a tab 27 is formed on the outside of the wall portion 28 of the end section 23 and below the outwardly extending flange 29. The tab 27 abuts against a corresponding tab on the intermediate section 25*a* and is coupled thereto by two dowels 30 and 31.

Respective projections 32 and 33 are formed on the insides of the wall portions of the two sections 23 and 25*a*. The two projections 32 and 33 abut together to form a single projection of the same shape as the projection 12 shown in FIG. 2, the projection 32 having inclined end surfaces 34 and 35 and the projection 33 having inclined end surfaces 36 and 37.

The projection 32 cooperates with a projection 38 formed in the adjacent corner of the end section 23 to provide a recess for a lug at one end of a cover to be fitted into the end section 23. The projection 33 cooperates with a projection 39 formed at the other end of the member 25*a* to provide a recess for a lug on a cover to be fitted into the intermediate section 25. Similar projections are formed at the other corners and joints so as to provide for two lugs on each cover, one at each end thereof. Installation may be carried out as described above, the frame being fitted to a ring beam 40.

The frame shown in FIGS. 3 to 5 may be used with the outwardly extending flange 29 resting on a manhole ring beam in the same manner as the frame shown in FIGS. 1 and 2. FIG. 6 shows the joint between the section 23 and the member 25*a*. Because the dimensions of the frame have to be such that the wall portion 28 can fit within the ring beam 28 when used in the manner shown in FIG. 4, an additional coupling member 42 must be provided when the frame is used as shown in FIG. 6. The coupling member 42 is of generally T-shaped cross-section with the stem of the T disposed between the bottom of the flange 29 and the top of the ring beam 40. The cross-bar of the T abuts against the inside of the frame and the ring beam, the two ends thereof being shaped to accomodate the difference in size between the frame and the ring beam.

In practice, packing (not shown) is inserted between the flange 29 and the coupling member 42 and/or the coupling member 42 and the ring beam 40 to bring the cover up to the required paved surface level. A coupling member similar to the coupling member 42 should be provided when the frame shown in FIGS. 1 and 2 is used with its flange 11 downwards.

Referring to FIG. 7, in either of the embodiments described above, the projections for engagement with lugs on the cover or covers may be replaced by a ledge running round the entire internal perimeter of the frame. The frame illustrated in FIG. 7, which is for use with a row of rectangular covers and is formed in interconnected sections as described with reference to FIGS. 4 and 5, comprises a wall portion 44 and an outwardly extending flange 45. Half way up the wall portion 44, an inwardly extending rib 46 provides alternative support surfaces 47 and 48 for supporting a cover level with the end of the wall portion to which the flange is attached and the other end thereof respectively.

An inwardly extending lug 49 is formed on the projection 46 at a joint between adjacent sections of the frame. The lug has alternative hook formations 50 and 51 for engagement in a recess 52 in one end of a bar 53 so as to support the latter with its top surface 55 level with whichever is uppermost of the support surfaces 47 and 48. The other end of the bar engages with a corresponding lug at the other side of the frame. Use of bars, such as the bar 55, which can be removed when the covers are removed enables each cover of a rwo to be supported around its entire periphery.

In all embodiments of the invention, the frame is preferably formed in one-piece from spheroidal graphite iron. The cover is also made from spheroidal graphite iron which ensures that the two parts fit together tightly. This is important as it prevents lateral movement or rocking of the cover within the frame. Alternatively other materials, such as cast iron or a plastics material can be used.

I claim

1. A method of positioning a frame in a paved surface for supporting an article of highway or carriageway furniture, said frame having an outwardly extending flange the upper surface of which is to coincide with the level of the finished surface, said method comprising the steps of placing the frame in a position below said level of the finished paved surface, holding the frame in said position utilising temporary support means, laying the surface material, and applying pressure to the newly applied surface so that newly laid road material is forced under the outwardly extending flange of the frame, whereby the frame is supported on this material by said flange and lifted to said level of the finished paved surface.

2. A method according to claim 1, wherein a roller is used for pressure to the newly applied surface.

3. A frame for supporting a member at the level of a paved surface, the frame being constituted by a wall portion surrounding an aperture whose cross-section matches that of the member to be supported, an outwardly extending flange projecting from one edge of the wall portion, and internally extending support means adapted to support said member with its top surface substantially level with said one edge of the wall portion when said one edge is uppermost and with the opposite edge of the wall portion to said one edge when said opposite edge is uppermost.

4. A frame according to claim 3, wherein said internal support means comprises a plurality of recesses extending from one edge of the wall portion to the other, each recess having tapering surfaces disposed perpendicular to the surface of the wall portion adjacent said recess so that the part of the recess intermediate the edges of the wall portion is narrower than the parts of the recess adjacent either edge of the wall portion.

5. A frame according to claim 3, wherein said internal support means comprises a projection extending around the entire inwardly facing side of the wall portion of the frame.

6. A frame according to claim 3, wherein the outwardly extending flange lies substantially at right-angles to the structure.

7. A frame according to claim 3, wherein the frame is made of spheroidal graphite iron.

* * * * *